US008171850B2

(12) United States Patent
Hanchett et al.

(10) Patent No.: US 8,171,850 B2
(45) Date of Patent: May 8, 2012

(54) CONDITIONAL ACTIVATION OF A CARTRIDGE

(75) Inventors: Mark A. Hanchett, Phoenix, AZ (US); Patrick W. Smith, Scottsdale, AZ (US); Alan I. Mossberg, Tierra Verde, FL (US); Alan Iver Mossberg, Branford, CT (US); William Lutton, Winsted, CT (US); Joseph H. Bartozzi, Woodbridge, CT (US)

(73) Assignee: TASER International, Inc., Scottsdale, AZ (US)

( * ) Notice: Subject to any disclaimer, the term of this patent is extended or adjusted under 35 U.S.C. 154(b) by 131 days.

(21) Appl. No.: 12/272,574

(22) Filed: Nov. 17, 2008

(65) Prior Publication Data

US 2010/0282113 A1 Nov. 11, 2010

Related U.S. Application Data

(60) Provisional application No. 60/989,036, filed on Nov. 19, 2007.

(51) Int. Cl.
*F42B 12/02* (2006.01)
*F41A 19/59* (2006.01)

(52) U.S. Cl. ..... 102/501; 102/512; 89/28.1

(58) Field of Classification Search ..... 102/501, 102/502, 512; 42/1.08, 84; 89/135, 28.05, 89/28.1; 361/232
See application file for complete search history.

(56) References Cited

U.S. PATENT DOCUMENTS 1,650,908 A 11/1927 Ramsey
1,887,324 A 11/1932 Pocoroba
2,809,564 A 10/1957 Pope
3,089,420 A 5/1963 Littleford
3,320,886 A 5/1967 DeLuca
3,404,598 A 10/1968 Angelos
3,407,526 A 10/1968 Freed
3,431,852 A 3/1969 Fowler
3,618,246 A 11/1971 Woodring
3,641,869 A 2/1972 Buchanan
3,728,967 A 4/1973 Hinkle
3,786,761 A 1/1974 Ciccone
3,802,430 A 4/1974 Schwebel
3,844,216 A 10/1974 Jakobs
3,858,342 A 1/1975 Langsford
3,859,746 A 1/1975 Pecksen
3,983,817 A 10/1976 Tucker
4,029,015 A 6/1977 Lachaussee
4,221,065 A 9/1980 Curran
4,315,462 A 2/1982 Vollers
4,440,062 A 4/1984 McQueen
4,478,150 A 10/1984 Sayler
4,575,962 A 3/1986 Rogak
4,738,202 A 4/1988 Hebert
4,843,336 A 6/1989 Kuo
(Continued)

*Primary Examiner* — Bret Hayes

(74) *Attorney, Agent, or Firm* — William R. Bachand; Lawrence Letham

(57) ABSTRACT

A weapon conditionally activates a cartridge. The cartridge has a projectile and a first mechanical feature. The weapon includes an activator and a station. The activator includes a second mechanical feature. The station positions the cartridge so that the first feature opposes the second feature. On condition that the first feature does not mechanically interfere with the second feature, the activator activates the cartridge to launch the projectile from the cartridge. On condition that the first feature mechanically interferes with the second feature resulting in an excess head space, the activator is inhibited by the excess head space from activating the cartridge.

37 Claims, 7 Drawing Sheets

U.S. PATENT DOCUMENTS

| | | | | | |
|---|---|---|---|---|---|
| 4,918,825 | A | | 4/1990 | Lesh | |
| 4,938,146 | A | | 7/1990 | Gunther | |
| 5,010,677 | A | | 4/1991 | Verney Carron | |
| 5,078,117 | A | | 1/1992 | Cover | |
| 5,086,703 | A | | 2/1992 | Klein | |
| 5,157,219 | A | | 10/1992 | Calsson | |
| 5,177,318 | A | | 1/1993 | Martinez | |
| 5,303,495 | A | | 4/1994 | Harthcock | |
| 5,309,842 | A | | 5/1994 | Matysik | |
| 5,685,100 | A | | 11/1997 | Atchison | |
| 5,698,815 | A | * | 12/1997 | Ragner | 102/502 |
| 5,698,816 | A | | 12/1997 | Roxby | |
| 5,714,710 | A | | 2/1998 | Roach | |
| 5,786,546 | A | | 7/1998 | Simson | |
| 5,791,327 | A | | 8/1998 | Riggs | |
| 5,834,681 | A | | 11/1998 | DuBay | |
| 5,900,577 | A | | 5/1999 | Robinson | |
| 5,979,331 | A | | 11/1999 | Casull | |
| 6,247,412 | B1 | | 6/2001 | Vornfett | |
| 6,293,204 | B1 | | 9/2001 | Regen | |
| 6,357,157 | B1 | | 3/2002 | Constant | |
| 6,360,468 | B1 | | 3/2002 | Constant | |
| 6,612,063 | B1 | | 9/2003 | Sigg | |
| 6,640,722 | B2 | | 11/2003 | Stogermuller | |
| 6,647,890 | B2 | | 11/2003 | Findlay | |
| 6,679,179 | B1 | * | 1/2004 | Bohl et al. | 102/501 |
| 6,679,180 | B2 | * | 1/2004 | Warnagiris et al. | 102/502 |
| 6,732,465 | B2 | | 5/2004 | Strayer | |
| 6,802,261 | B2 | * | 10/2004 | Warnagiris et al. | 102/502 |
| 6,832,557 | B2 | | 12/2004 | Torsten | |
| 6,862,994 | B2 | | 3/2005 | Chang | |
| 6,880,466 | B2 | * | 4/2005 | Carman | 102/502 |
| 6,976,431 | B2 | | 12/2005 | Westrom | |
| 7,004,074 | B2 | | 2/2006 | Van Stratum | |
| 7,065,915 | B2 | * | 6/2006 | Chang | 42/84 |
| 7,096,792 | B1 | * | 8/2006 | Carman | 102/502 |
| 7,143,697 | B2 | | 12/2006 | Mace | |
| 7,327,549 | B2 | * | 2/2008 | Smith et al. | 361/232 |
| 2003/0094113 | A1 | * | 5/2003 | Warnagiris et al. | 102/502 |
| 2003/0145754 | A1 | | 8/2003 | Saxby | |
| 2004/0089187 | A1 | * | 5/2004 | Warnagiris et al. | 102/502 |
| 2005/0039628 | A1 | * | 2/2005 | Carman | 102/502 |
| 2005/0188887 | A1 | * | 9/2005 | Chang | 102/502 |
| 2006/0143966 | A1 | | 7/2006 | Reynolds | |
| 2006/0162605 | A1 | * | 7/2006 | Genis et al. | 102/512 |
| 2006/0254451 | A1 | | 11/2006 | Olofsson | |
| 2007/0101893 | A1 | * | 5/2007 | Shalev et al. | 102/512 |
| 2008/0289531 | A1 | * | 11/2008 | Genis et al. | 102/502 |
| 2009/0255435 | A1 | * | 10/2009 | Genis et al. | 102/502 |
| 2010/0101445 | A1 | * | 4/2010 | Garg | 102/502 |

* cited by examiner

CONDITIONAL ACTIVATION OF A CARTRIDGE

CROSS REFERENCE TO RELATED APPLICATION

This application claims the benefit under 35 U.S.C. §119 (e) of U.S. Provisional Patent Application Ser. No. 60/989,036 by Mark Hanchett et al., filed Nov. 19, 2007, entitled "Apparatus and Methods for Conditional Activation of a Cartridge," incorporated herein by reference.

BRIEF DESCRIPTION OF THE DRAWING

Embodiments of the present invention are described with reference to the drawing wherein like designations denote like elements, and.

DETAILED DESCRIPTION OF THE PREFERRED EMBODIMENTS

Figure 1:
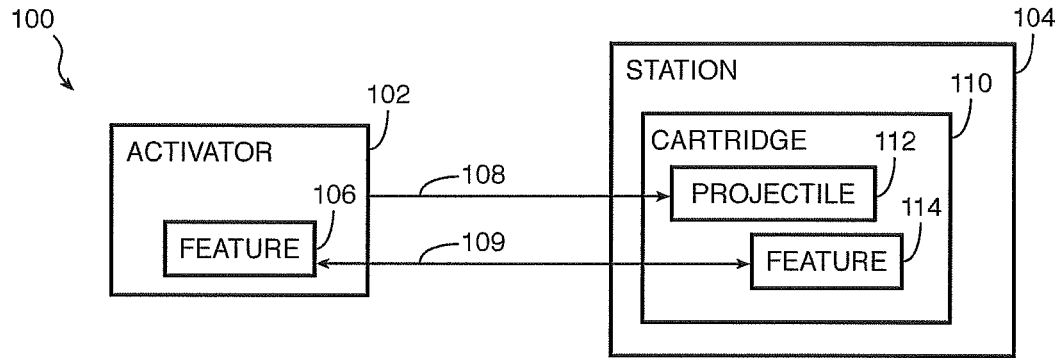
FIG. 1 is a functional block diagram of a system, according to various aspects of the present invention, that conditionally activates a cartridge.

A system, according to various aspects of the present invention, conditionally activates a relatively limited use portion of the system according to whether features are compatible or incompatible. Activation may include initiating any function of the relatively limited use portion of the system. A system that conditionally activates a relatively limited use portion of the system may inhibit activation of an unsuitable and/or unintended relatively limited use portion of the system. Inhibiting activation may include aborting an automatic or manual activation method and/or making activation improbable. Activation may become improbable when, for example, a user must deviate from methods of ordinary operation of the system and/or use of the system and resort to the use of tools, not customarily accessed for ordinary operation, to modify at least a portion of the system to succeed in achieving activation. Inhibiting activation may be accomplished by the system as a consequence of a portion of the system detecting an incompatibility. The incompatibility may be between at least a portion of the system and at least a portion of the relatively limited use portion of the system. Detecting an incompatibility may be accomplished by failing to detect a sufficient compatibility.

Some of the principles of manufacture and operation of a system according to various aspects of the present invention will be described for clarity with reference to a weapon system, though other principles and applications in analogous arts will be evident to a person of ordinary skill in analogous arts. Such a weapon system includes a relatively limited use portion and a relatively unlimited use portion. The relatively limited use portion is herein called a cartridge (e.g., a one-time consumable use portion such as a portion containing a single use amount of propellant for propelling the projectile). The relatively unlimited use portion (e.g., used with thousands of cartridges) is herein called a weapon. Consequently, a cartridge is distinguished from a weapon regardless of whether each may or may not be harmful in use or misuse.

A weapon system, according to various aspects of the present invention, may exhibit increased operational safety for the weapon system user and/or may provide more appropriate use of force against a human or animal target. Weapons, cartridges, and weapon systems described herein may be non-interoperable among each other. Non-interoperability may segment the market and/or applications for weapons, cartridges, and weapon systems, promoting user safety among other benefits. Each weapon system may be limited so as to be consistent with particular legal, moral, social, strategic, and/or tactical purposes that may be special to a particular application. Weapon systems with various superset capabilities are also feasible, according to various aspects of the present invention.

A cartridge, according to various aspects of the present invention, may include any package of materials that are not practical to reuse after operating with a weapon as discussed herein. A cartridge may deploy one or more types of force in one or a limited number of uses (e.g., one type of force per cartridge type, a multi-shot magazine for deploying different forces). A force that has a relatively high likelihood of being lethal to animal and/or human targets is herein called lethal for convenience. A force that has a relatively low likelihood of being lethal is herein called non-lethal for convenience. The force may comprise blunt impact, intimidate or distract the target, cause pain due to electric current through the target tissue, and/or exert electric control of the target. Electric control may be accomplished in a conventional manner by passing a current through target tissue that interferes with voluntary use by the target of its skeletal muscles. Electric control may halt locomotion by the target. For a cartridge having wire-tethered electrodes, the current may be passed between wire-tethered electrodes that connect a signal generator (not shown) in the weapon with the electrodes that impale the clothing and/or tissue of the target. For a cartridge using a wireless electrified projectile, electric control may be accomplished without tether wires when the signal generator and electrodes are packaged in a conventional electrified projectile that hits the target, and conducts the current through electrodes of the projectile and through the target.

A weapon, according to various aspects of the present invention, may include any apparatus having an activator and a station that accepts a cartridge, the cartridge not being part of the weapon. Weapons that may be adapted to use the technology disclosed herein include, for example, hand-held electronic control devices (e.g., TASER brand models M26, X26, C2 marketed by TASER International, shields), conventional arms (e.g., pistols, shot guns, rifles, dart guns), conventional tactical weaponry (e.g., grenade launchers, area denial devices, TASER brand model ShockWave marketed by TASER International, mines, vehicle and/or robot mounted arms and electronic control devices), and electrified projectiles (e.g., TASER brand model XREP marketed by TASER International).

Activating the cartridge may accomplish a deployment of a force against a target. For example, weapon system 100 of FIG. 1 includes a weapon having activator 102 and station 104. Activator 102 has feature 106 and activates (108) cartridge 110. Cartridge 110 includes projectile 112 and feature 114. A feature 106 of an activator interacts (109) with a feature 114 of a cartridge. Activation is conditioned on compatibility of feature 106 and feature 114. Weapon system 100 emits a projectile 112 from cartridge 110 to deploy a force against a target. Cartridge 110 may correspond to a relatively limited use portion of weapon system 100.

An activator, according to various aspects of the present invention, activates (e.g., by mechanical, electrical, magnetic, and/or electromagnetic cooperation) propulsion (e.g., launching) of a projectile of a cartridge if at least one condition is met; and, does not activate when at least one condition is not met. An activator includes a feature that is compatible or incompatible with a feature of a cartridge. Incompatibility results when the condition is not met. Incompatibility may be evident as excess head space, as discussed herein. An activator may include any structure that inhibits activation when a condition is not met.

An activator may include a feature that is not compatible with a feature of a cartridge. Compatible features may be complementary. Incompatible features may be similar, for example, a first type of activator 102 may include a protrusion 106 that opposes a protrusion 114 of a first type of cartridge 110. Incompatibility may result when an activator omits any structure that would have been sufficient for satisfying a condition imposed by an opposing feature of a cartridge. For example, a second type of activator 102 may omit a recess 106 for nesting with a protrusion 114 of a second type of cartridge 110. Other types of activators, according to various aspects of the present invention, may include one or more features that are not complementary to features of particular types of cartridges and, in addition, may omit one or more features that would have been sufficient to be compatible with particular types of cartridges.

Activation may be inhibited. For an activator (e.g., a percussion firing mechanism) that includes a trigger (e.g., a manual hammer or bolt mechanism), activation may be inhibited by decoupling the trigger from the activator and/or blocking operation of the trigger. For a weapon that includes a station, activation may be inhibited by decoupling the activator from the station and/or blocking operation of the activator to affect activation of the cartridge at the station. For a weapon that has a station that receives a cartridge prior to activation, inhibiting activation may include blocking the cartridge from being received by the station and/or blocking an operation of the station. Blocking may include introducing a mechanical interference (e.g., an abutment surface, an increased friction) that interferes with attaining a position of the station relative to the cartridge and/or relative to the activator (e.g., blocking closure of the station, blocking movement between the cartridge and a breech block and/or bolt of the station that would otherwise locate such against the cartridge). For a weapon that has a station that encloses a cartridge prior to activation, inhibiting activation may include blocking the cartridge from being enclosed (e.g., blocking closure of the station). For percussion-fired cartridges (e.g., center-fired, rim-fired), an activator may include a firing pin. For electrically-fired cartridges, an activator may include contacts for conducting a firing current through the cartridge. One or more of these contacts may also be used for conducting a current through the target, as discussed above. An activator may include a source of electromagnetic energy (e.g., electricity, magnetism, radiation, light) for activating a cartridge via a transfer of energy and/or communication of a signal. Inhibiting activation may include blocking operation of a firing pin or blocking (or shunting) a current for activation.

A station accepts a cartridge. A station may maintain a position of the cartridge so that the cartridge may be effectively activated by an activator. A cartridge may be combined with a station prior to activation. Combining may include the station accepting, receiving, supporting, holding, and/or enclosing the cartridge. Effective activation may occur at the station at least in part because the station is located proximate to the activator (e.g., within a tolerance of a prescribed distance). A station may support a cartridge. A station may hold a cartridge for later activation. A station may produce, control, and/or direct a force of propulsion. A station may enclose a cartridge. For propulsion by expanding gas, a station may direct an explosive release of gas that propels a projectile from the cartridge away from the station. For example, station 104 accepts and holds cartridge 110 within a distance from activator 102 from before activation and at least until activation is begun.

A cartridge, according to various aspects of the present invention, includes a projectile and one or more features. A cartridge holds at least one projectile prior to propelling the projectile away from the cartridge. The projectile may be tethered to the cartridge before, during, and after being propelled away from the cartridge, as discussed herein for wire-tethered electrode systems. The projectile may be propelled free of the cartridge, as discussed above for wireless electrified projectile systems. A projectile deploys a force against the target, as discussed above. A cartridge may include a propellant for propelling the projectile (e.g., a pyrotechnic charge and/or a container of compressed gas). A cartridge may omit the propellant when, for example, an activator includes (or cooperates with) a suitable propellant (e.g., a compressed gas supply).

A feature, of an activator or a cartridge, may govern whether the cartridge meets at least one condition sufficient for activation. When a condition of effective activation is satisfied on condition that the station is proximate to the activator (e.g., within a tolerance of a prescribed distance), one or more features may interfere with achieving such a condition by separating the station from the activator and/or enforcing a separation.

A feature may have dimensions and location so as not to interfere with removal (e.g., extraction) of a cartridge from a station. A feature may have dimensions and location so as not to participate in removal. A feature, as discussed herein, may be located closer to a central axis of the cartridge than any structure associated with a removal function.

For example, an activator may be effective for activation when a space (e.g., a head space) between the activator and the cartridge is less than a maximum distance (e.g., compatible interaction 109). The activator may be ineffective (e.g., unable to reliably activate the cartridge) when a physical interference (e.g., abutment of feature surfaces) causes more than the maximum distance to exist (e.g., excess head space). Interference may result from abutment between one or more features of the cartridge and one or more features of the activator. Interference may result from incompatibility between one or more features of the activator and one or more features of the cartridge. Incompatibility may exist when a feature (e.g., a protrusion) does not nest within a complementary feature (e.g., a recess). Failure to nest may result from the absence of a complementary feature opposite a particular feature and/or misalignment of a complementary feature with the particular feature.

For example, cartridge 110 may include a wireless electrified projectile 112, a percussion fired pyrotechnic propellant for propelling the projectile, a base to receive a firing pin for percussion fired activation 108 wherein the base includes a protrusion feature 114 that causes excess head space (e.g., incompatible interaction 109) if an attempt is made to use the cartridge 110 with an incompatible activator 102 that does not include a suitable recess feature 106 to nest the protrusion.

As another example, cartridge 110 may include a wire-tethered projectile 112, an electrically fired pyrotechnic propellant in combination with a compressed gas propellant, an enclosure with contacts to receive a current signal 108 for activation, and a flat (omission of a sufficient recess) feature 114 that causes excess head space (e.g., incompatible interaction 109) if an attempt is made to use the cartridge 110 with an incompatible activator 102 that has a protrusion feature 106.

Combining a cartridge and a station may be accomplished with manual, automatic, or combinations of manual and automatic operations. For example, system 200 of FIG. 2 includes activator 102, feature 106, station 104, cartridge 110, and feature 114 as discussed above. Further, system 200 includes coupler 202, guide 204, positioning mechanism 206, and removing mechanism 208. Weapon system 200 emits projectile 112 from cartridge 110 and through guide 204 to deploy a force against a target.

A guide guides at least one projectile from the cartridge in a manner that improves the accuracy of hitting the target with a projectile. A guide may have an axis on which the projectile is guided. A guide may control propulsion of one or more projectiles and/or direct one or more moving projectiles from the cartridge toward the target. For example, guide 202 guides projectile 112 of cartridge 110 when projectile 112 is being propelled away from system 200.

A coupler couples an activator and a compatible cartridge (e.g., by mechanical, electrical, magnetic, and/or electromagnetic cooperation) so that operation of the activator activates the cartridge. A coupler may cooperate with a positioning mechanism and a station to initiate the holding function of the station in response to completing the positioning function of the positioning mechanism. A coupler may cooperate with a removing mechanism after a cartridge combined with a station to prepare the removing mechanism for operation. A coupler may be manually operated as to any or all of its functions. A coupler may be automatically operated as to any or all of its functions. A coupler may detect an incompatibility between a cartridge and an activator. In response to detecting an incompatibility, a coupler may inhibit activation in any manner as discussed above. A coupler may cooperate with a removing mechanism (e.g., by mechanical, electrical, magnetic, and/or electromagnetic cooperation) to initiate removing in response to detecting an incompatibility between the cartridge and the activator.

For example, coupler 202 may enclose (e.g., by mechanism or signal 212) a compatible cartridge 110 in station 104 at a suitable distance from activator 110 in preparation for activation. If the cartridge in the station and/or coupler is not compatible, coupler 202 may inhibit activation (e.g., by mechanism or signal 210), as discussed above, for example, by blocking operation of a trigger and/or blocking enclosing the cartridge. The station may have a first position for receiving a cartridge and a second position for enclosing the cartridge. The coupler may block (e.g., by introducing a mechanical interference) the station from attaining the second (e.g., closed) position.

A positioning mechanism places a compatible cartridge in a position suitable for activation. Positioning may include placing and orienting the cartridge with respect to the station. A positioning mechanism may place a cartridge in a station of a guide, as discussed above. A positioning mechanism may be manually operated as to any or all of its functions. A positioning mechanism may be automatically operated as to any or all of its functions. A positioning mechanism may detect an incompatibility between the cartridge being positioned and an activator. In response to detecting an incompatibility, a positioning mechanism may inhibit activation in any manner as discussed above. A positioning system may cooperate with a removing mechanism (e.g., by mechanical, electrical, magnetic, and/or electromagnetic cooperation 222) to initiate removal in response to detecting an incompatibility between the cartridge being positioned and an activator. For example, positioning mechanism 206 opens, via mechanism or signal 216, station 104 for an operator to manually place a compatible cartridge 110 in station 104. Positioning mechanism then moves the cartridge into a suitable position, via mechanism or signal 214. If the cartridge placed by the operator is not compatible (e.g., as detected by mechanism or signal 216 and/or 214), positioning mechanism 206 inhibits activation by activator 102. Inhibiting activation may be as discussed above. Inhibiting may include blocking operation of coupler 202 via mechanism or signal 210 and/or 212. Inhibiting may include blocking operation of a trigger of activator 102 and/or blocking enclosing cartridge 110 in station 104.

A removing mechanism removes a cartridge from a station. A removing mechanism may decouple a compatible cartridge from an activator prior to or in combination with removing. A removing mechanism may remove an incompatible cartridge from a station. A removing mechanism may include one or more extractors. An extractor may cooperate with a structure (e.g., lip, tang, ridge, flange) of a cartridge to perform the holding function discussed with reference to the station. The structure may be on an external surface of the cartridge or internal (e.g., within a cavity of an external surface of the cartridge. An extractor may cooperate with a structure of a cartridge to throw the cartridge away from the station. A removing mechanism may be manually operated as to any or all of its functions. A removing mechanism may be automatically operated as to any or all of its functions. For example, removing mechanism 208 may open an enclosure of station 104 and remove (e.g., by operation of extractors) a compatible cartridge 110 from station 104. Opening and or removing may utilize mechanism and/or signal 218 and/or 220. Removing may be initiated (e.g., by the system user and/or by positioning mechanism 206) whether or not the cartridge 110 was activated. Further, removing mechanism 208 in response to returning station 104 to an open position may remove an incompatible cartridge 110 from station 104.

For propulsion by expanding gas, a guide may include a barrel. An activator, station, coupler, positioning mechanism, and removing mechanism may be implemented at a breech end of the barrel with a breech block, a bolt, a receiver, a chamber, a trigger, and one or more extractors. At a muzzle end of the barrel, one or more projectiles from the cartridge are emitted.

Guide 204 may be omitted from another implementation of weapon 200 (not shown). For example, a cartridge may include sufficient structure to guide a projectile away from the cartridge, eliminating the need for a guide 204.

Positioning mechanism 206 and/or removing mechanism 208 may be omitted for another implementation of weapon 200 (not shown). For example, positioning and/or removing may be accomplished by operator action and the cooperation of surfaces of a cartridge (not shown) and a station (not shown), eliminating the need for a positioning mechanism 206 and/or a removing mechanism 208.

As discussed above, a condition of compatibility between feature 106 and 114 may be detected by one or more of activator 102, coupler 202, positioning mechanism 206, and/or one or more extractors. Actions taken in response to detecting an incompatibility, according to various aspects of the present invention, include inhibiting activation and/or removing the cartridge from the weapon (e.g., from the station if already received by the station). Attempting repositioning of the cartridge by positioning mechanism 206 may be warranted where the time to attempt repositioning represents a reasonable cost over the cost of the cartridge in view of the likelihood of success for the attempt.

Figure 3:
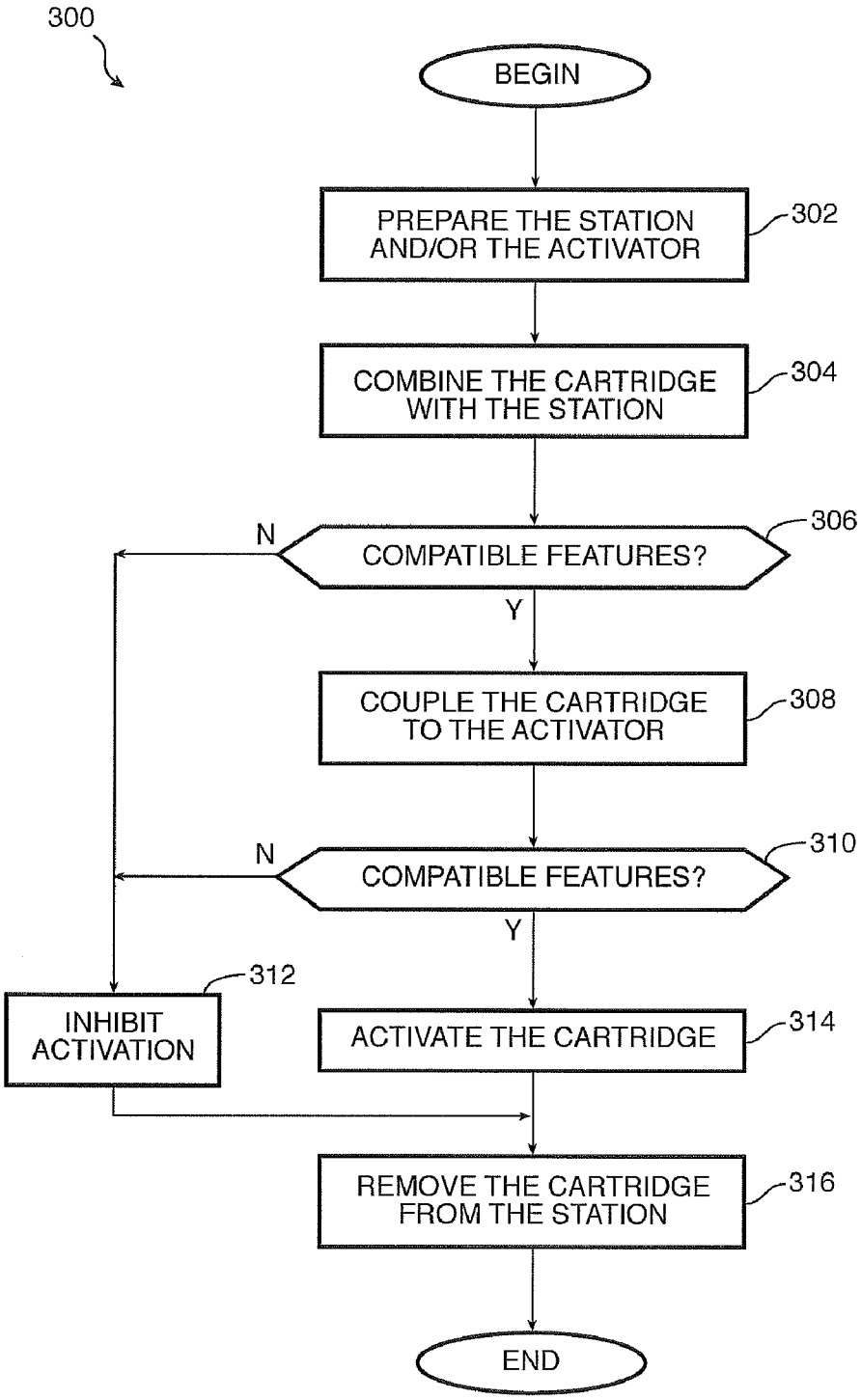
FIG. 3 is a process flow diagram of a method, according to various aspects of the present invention, for conditionally activating a cartridge.

Systems 100 and/or 200 may perform a method for conditionally activating a cartridge. Inhibiting activating a cartridge may attain any one or more of the results discussed above. For example, method 300 of FIG. 3 may be performed for each of several cartridges (or portions of a magazine) handled manually or automatically (e.g., fed automatically, automatically advanced).

Method 300 begins with preparing (302) the station (e.g., 104) and/or the activator (e.g., 102). Preparation may instate or reinstate any suitable initial condition of activation of a next cartridge (e.g., 110). For example, preparation may include opening a receiver to admit the cartridge. Preparation may include retracting a bolt and/or a breech block. Preparation may include recharging an energy storage mechanism and/or circuit so that sufficient energy is available for activation and/or current through target tissue.

The cartridge (e.g., 110) is combined (304) with the station (e.g., 104). Combining may include accepting, receiving, positioning, supporting, holding, orienting (e.g., to achieve indexing and/or alignment), and/or enclosing. Combining may be incomplete for an incompatible cartridge.

As a result of an attempt to combine (304), compatibility of features of the activator (e.g., one or more features 106) with features of the cartridge (e.g., one or more features 114) may be detected (306). For example, opposing features may nest (compatible) or abut (incompatible). Excess head space may be detected. If these features are incompatible, the method continues with inhibiting (312). Otherwise the method continues with coupling (308).

The cartridge is coupled (308) to the activator (e.g., by coupler 202). Coupling may include moving the cartridge with respect to the station and/or the activator. Movement may be in any linear direction. Movement may be along any arc. Coupling may include indexing (e.g., moving to align an index structure of a cartridge with an index structure of a station and/or of an activator). Coupling may include providing for operator safety as a prerequisite to activating. Coupling may include closing a chamber around the cartridge. Attempting coupling may result in achieving a suitable head space or in failing to achieve a suitable head space (e.g., detecting excess head space). Coupling may be incomplete for an incompatible cartridge.

As a result of an attempt to couple (308), compatibility of features of the activator (e.g., one or more features 106) with features of the cartridge (e.g., one or more features 114) may be detected (310). For example, opposing features may nest (compatible) or abut (incompatible). Excess head space may be detected. If these features are incompatible, the method continues with inhibiting (312). Otherwise, the method continues with activating (314).

If incompatible features are detected, activation is inhibited in any manner as discussed herein.

If compatible features are detected, the cartridge is activated (314). Activation is permitted because a condition of compatibility has been met (e.g., incompatibility has not been detected, sufficient compatibility has been detected, and/or insufficient incompatibility has been detected). Activation may include propelling the projectile from the cartridge. Activating may include initiating and/or repeating provision of a current through target tissue.

The cartridge is removed (316) from the station. Removing may include releasing, ceasing holding, and/or extracting.

If the weapon and cartridge are designed for multi-threaded operation of method 300, another performance of method 300 may be performed with respect to a second cartridge at any time, whether or not a first cartridge is removed.

The conditional activation, described above for systems 100 and 200 and method 300, may be implemented with mechanical structures. For example, a cylindrical cartridge may be placed for activation against a breech block having a firing pin. If excess head space does not arise from incompatible features in a region of a portion of the breech block and a portion of the cartridge, activation by percussion of a center firing pin against the cartridge may be accomplished. Otherwise, excess head space may inhibit activation by exceeding the operating range of the firing pin. For example, a portion of weapon system 400 is shown in cross-section in FIG. 4. Weapon system 400 generally includes circularly symmetric structures that are symmetric about an axis 402, the axis of projection of the projectile. Weapon system 400 includes receiver 404 that has an open position and a closed position (shown in the closed position). Weapon system 404 further includes extractor 406, bolt 408, firing pin 410, and cartridge 412.

Receiver 404 includes radial surfaces 420 and 421. When receiver 406 is in the open position, surfaces 420 and 421 are located a considerable distance along axis 402 away from bolt 408. When receiver 406 transitions from the open position to the closed position (as shown), ejector 406 is urged toward cartridge 412 and the distance between bolt 408 and cartridge 412 is reduced. To achieve the closed position, surface 418 of extractor 406 must grasp lip 416 of cartridge 412; and extractor 406 surface 430 must avoid abutting surface 421. In the presence of excess head space, extractor 406 cannot grasp lip 416 in a manner that also avoids extractor 406 from abutting surface 421. Consequently, the closed position cannot be attained. Extractor 406 may abut surface 421 if an attempt to put receiver 404 into the closed position fails. Such an attempt may fail because excess head space prevents location of extractor 406 as shown.

When transitioning into the closed position, bolt 408 and cartridge 412 may move together to oppose each other and may be held against each other at least in part by operation of extractor 406. Consequently, firing pin 410 is aligned on axis 402 through a center fired axis of cartridge 412. Further, a distance between firing pin 410 and a base 414 of the cartridge is brought within an operating distance for reliable activation. As shown, opposing features in region 422 are nested, indicating compatibility of features and an absence of excess head space.

Bolt 408 provides a bore for firing pin 410. Bolt 408 further includes chamfer 426 and recess 424 in region 422. Chamfer 426 cooperates with extractor 406 to throw cartridge 412 out of receiver 404 when receiver 404 transitions from the closed position to the open position. Because recess 424 is aligned to nest with protrusion 428 of cartridge 412, excess head space does not exist. By abutting base 414 of cartridge 412, bolt 408 may detect excess head space and may inhibit activation as discussed above.

Cartridge 412 includes base 414 which is generally flat except for features in region 422. Region 422 includes a protrusion feature 428 that inhibits activation of cartridge 412 in the absence of a corresponding recess feature 424 of bolt 408. Both protrusion feature 428 and recess feature 424 may have circular symmetry about axis 402 (e.g., formed on a circle, formed as a half annulus).

Extractor 406 is one of two extractors that are located diametrically opposite each other across axis 402. Extractors pivot away from bolt 408 to receive a cartridge and pivot toward bolt 408 to grasp a cartridge. By grasping a cartridge, extractors may detect excess head space and may inhibit activation as discussed above. An extractor may perform any function of a positioning mechanism (e.g., moving a cartridge toward an activator), any function of a coupler (e.g., mechanically and/or electrically coupling a cartridge to an activator), any function of a station (e.g., holding a cartridge at a distance (zero or more) from an activator, and/or any function of a removing mechanism (e.g., throwing a cartridge away from an activator) as discussed herein.

Figure 4:
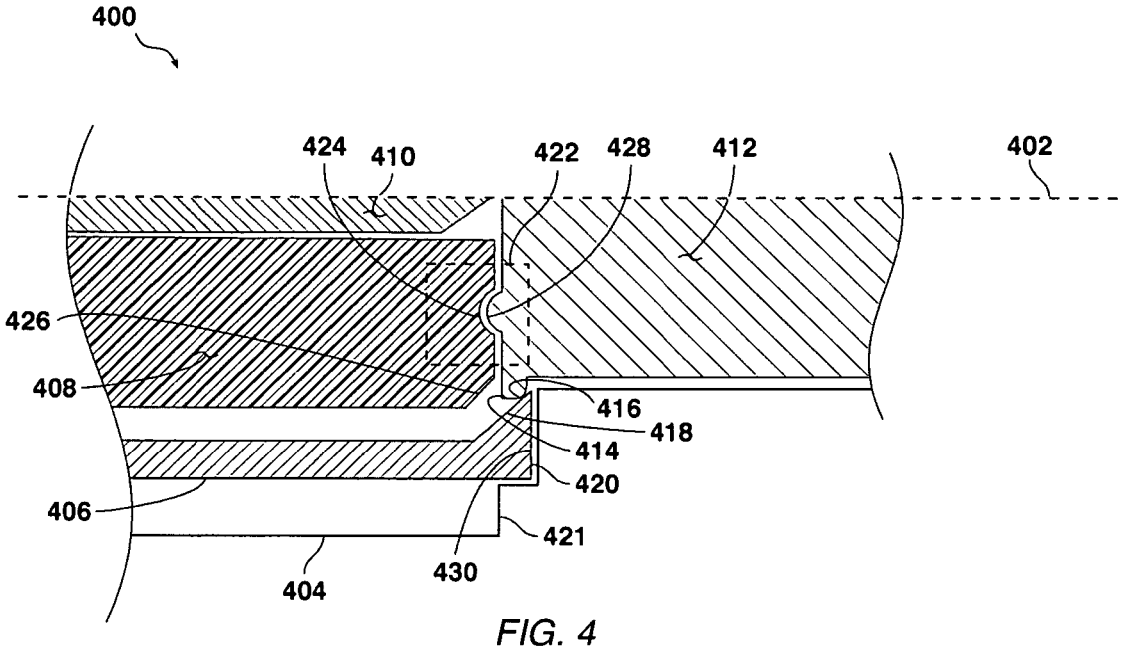
FIG. 4 is a cross-sectional view of a portion of a system according to FIG. 2.

Region 422 of FIG. 4 illustrates a feature 424 of an activator compatible with and nested with a feature 428 of a cartridge.

Figure 5A:
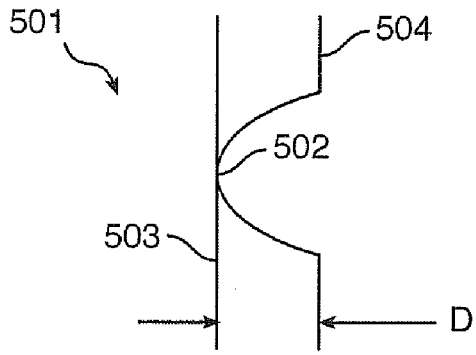
FIGS. 5A, 5B, and 5C are cross-sectional views of incompatible features, according to various aspects of the present invention.
Figure 5B:
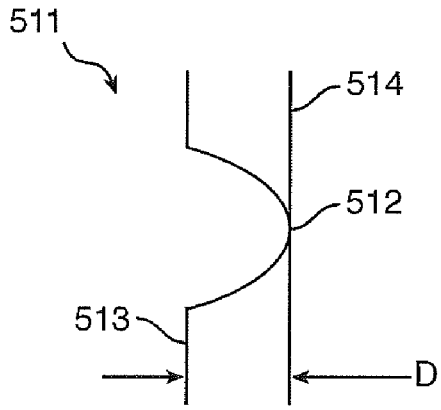
Figure 5C:
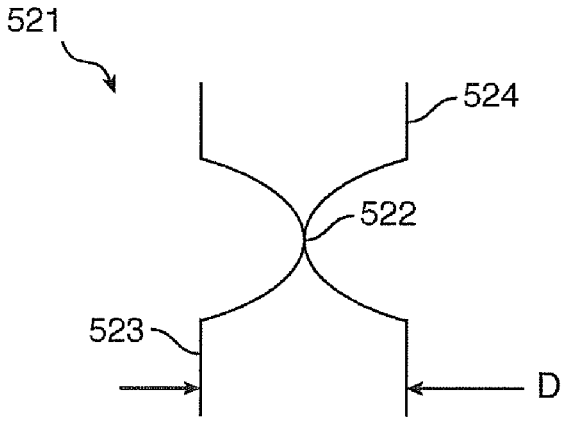

Combinations of incompatible features are illustrated in FIGS. 5A, 5B, and 5C. In all three illustrations, opposing surfaces define a distance D that is detectable, as discussed above, and indicates incompatibility (e.g., insufficient compatibility). Distance D may cause an activator, coupler, station, positioning mechanism, or ejector to inhibit activation directly (e.g., open a circuit intended for firing current, separate a firing pin from a cartridge) or indirectly (e.g., prevent closing of a breech, block operation of a trigger).

Opposing surfaces having features as discussed herein may be located at any convenient portion of an activator and a cartridge. As an alternative or in addition, opposing surfaces having alternative and/or additional features may be located at any desired portion of a cartridge and a station. For example, detecting incompatibility and inhibiting activation may be accomplished by a station in response to incompatible features of opposing surfaces.

Compatibility and incompatibility may be implemented with any opposition of 2 surfaces each having one of 3 features: flat, recess, or protrusion. The combinations are listed in Table 1. In Table 1, the features of the first and second surfaces are assumed to completely overlap. If overlap is not sufficient, some combinations indicated as compatible may be incompatible.

TABLE 1

| First Surface | Second Surface | Compatible (Yes/No)? |
|---|---|---|
| Flat | Flat | yes |
| Flat | Recess | yes |
| Flat | Protrusion | no (e.g., FIG. 5A) |
| Recess | Flat | yes |
| Recess | Recess | yes |
| Recess | Protrusion | yes |
| Protrusion | Flat | no (e.g., FIG. 5B) |
| Protrusion | Recess | yes |
| Protrusion | Protrusion | no (e.g., FIG. 5C) |

In FIG. 5A, surface 504 opposes surface 503 in region 501. At point 502, a flat of surface 503 abuts a protrusion of surface 504.

In FIG. 5B, surface 514 opposes surface 513 in region 511. At point 512, a protrusion of surface 513 abuts a flat of surface 514.

In FIG. 5C, surface 524 opposes surface 523 in region 521. At point 522, a protrusion of surface 523 abuts a protrusion of surface 524.

Features to be opposed for detecting compatibility may be located on a surface without regard to symmetry. The surface may otherwise be substantially flat or may have any convenient topography. As an addition or alternative, features to be opposed for detecting compatibility may be located in circular tracks about a center of circular symmetry on a substantially flat surface. The region (e.g., 422) for features may also exhibit circular symmetry. Circular symmetry and regions of substantially flat surfaces (e.g., portion of base of cartridge, portion of face of bolt and/or breech block) are conventional for activators and cartridges used in percussion fired weaponry. Because the angular orientation about a central axis of circular symmetry may be costly to control, a feature may be implemented on a circle as a protrusion from the flat surface of the region or as a recess into the flat surface of the region. Multiple features at circles of differing radii may be used in the same region (e.g., a circular band of several circular tracks).

Figure 6:
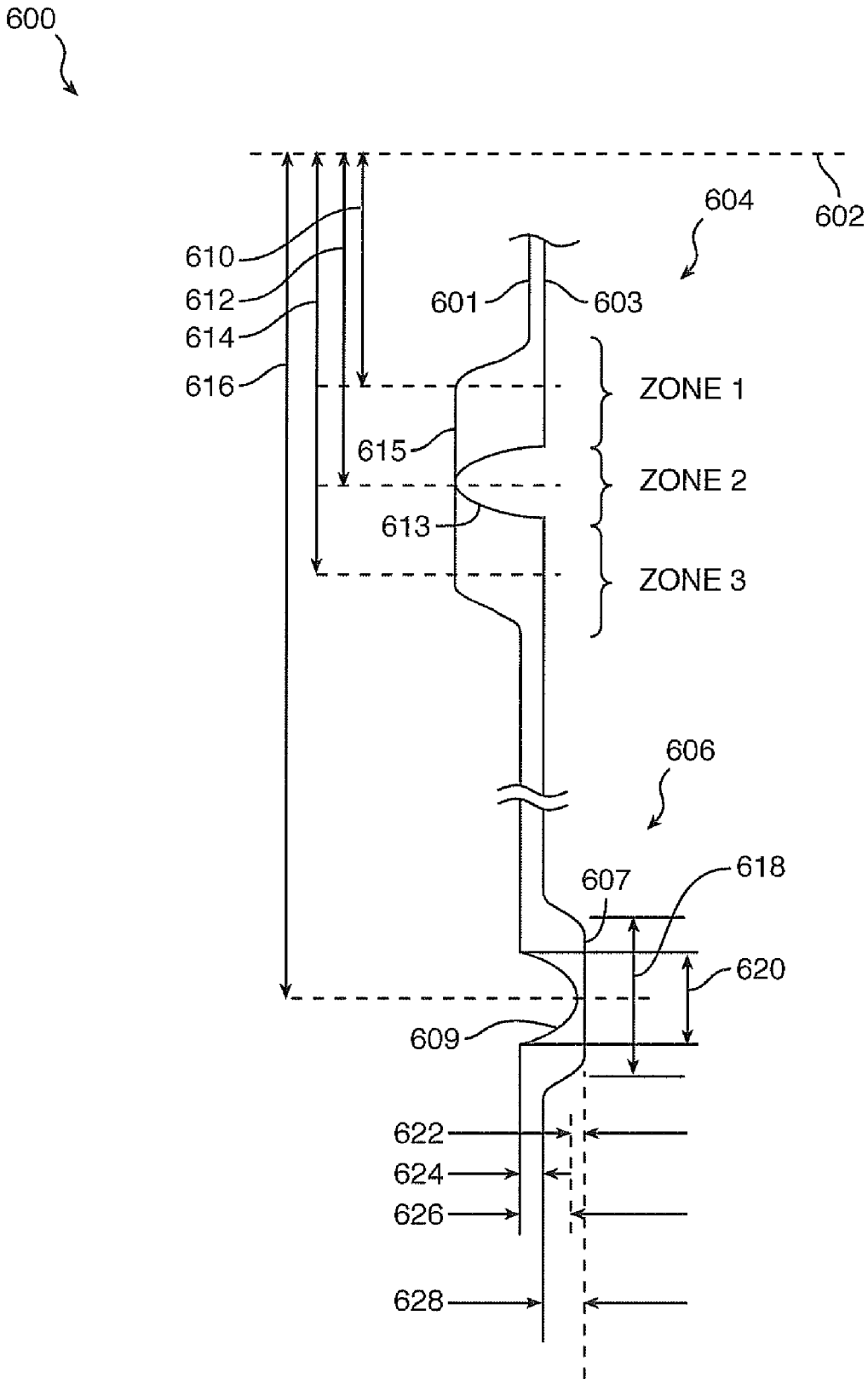
FIG. 6 is a cross-sectional view of a region having compatible features, according to various aspects of the present invention.
Figure 7:
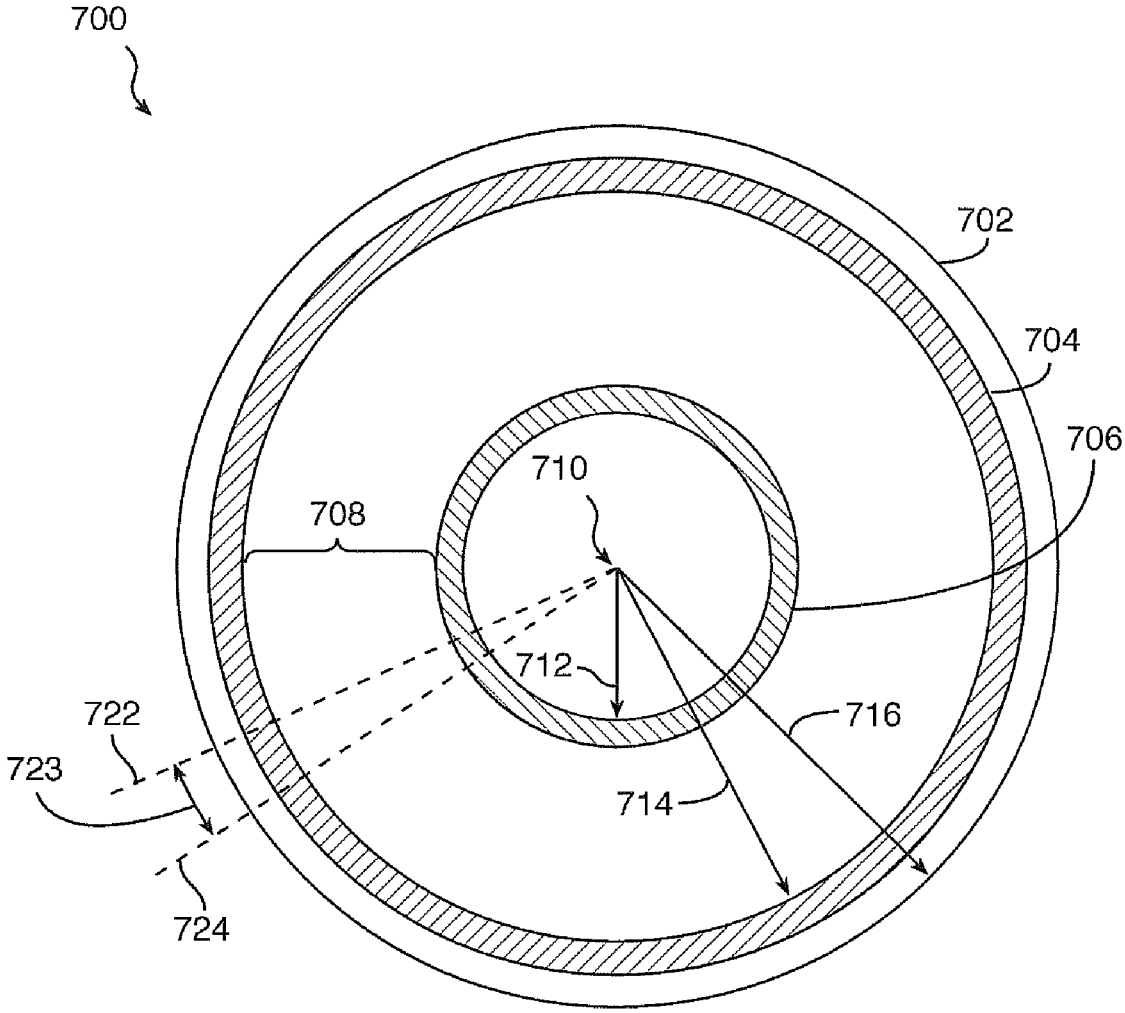
FIG. 7 is a plan view of a region having features for conditional activation, according to various aspects of the present invention.

For example, circularly symmetric features of a circularly symmetric region are shown in cross-section in FIG. 6. Region 600 is circular about axis 602. Axis 602 may correspond to the center of an axis of symmetry of an activator, a cartridge, or both and activator and a cartridge. Region 600 includes surface 601 abutting surface 603. Region 600 includes compatible features at nested tracks 604 and nested tracks 606. Each track is circular about axis 602. All radii discussed below are measured from axis 602.

Surface 601 includes a recess feature 615 that includes zone 1 centered at radius 610, zone 2 centered at radius 612 (greater than radius 610), and zone 3 centered at radius 614 (greater than radius 612). Zone 2 includes a protrusion feature 613 from surface 603 that abuts recess feature 615. Width boundary zones 1 and 3 may serve one or more purposes including: (a) to provide space for foreign substances that could otherwise interfere with nesting of protrusion feature 613 in recess feature 615; (b) to provide for tolerances in forming features and for wear of the type of features that may be deformed by exposure to incompatibilities; (3) to provide for tolerances in positioning and holding the cartridge in the station, as discussed above; (4) to provide for tolerances in alignment of the cartridge and/or station and the activator; and/or (5) to avoid interfering with extracting the cartridge from the station.

Surface 601 includes a protrusion feature 609 at radius 616 (greater than radius 614) that nests in recess feature 607 of surface 603. Width 620 of protrusion feature 609 is smaller than width 618 of recess feature 607 by an amount sufficient for boundary zones (not shown, but analogous to zones 1 and 3). Feature 609 height 626 and feature 607 depth 628 may be measured at the intended central radius 616 of the overlap of the features. Due to irregularities in surface flatness and forming of surfaces and features, some portions of some features may not abut when nested. Proper activation should allow for spaces 624 between substantially (e.g., imperfectly) flat surfaces and the effects (e.g., rocking) of spaces 622 between features that are nested. These spaces may contribute to a head space that, though not zero, still indicates compatibility.

Widths of features may be measured where the feature height or depth differs from the surface by 10%. Widths of features may be selected to effect reliable detection without interfering with removal (e.g., extraction). When features are used to define several types of compatibility, feature width may be adjusted to assure each type of compatibility is distinguishable from each other type.

Feature height for a protrusion may be determined by a distance at which a positioning mechanism will inhibit normal operation of the weapon (e.g., fail to permit a breech to close, fail to permit a trigger to effect activation). Feature height for a protrusion may be determined by a distance at which an activator cannot reliably activate (e.g., beyond the distance a firing pin will reliably strike a primer, beyond the distance an electric circuit can be formed through the cartridge). Feature height for a protrusion may be reduced from the determinations just mentioned to assure the protrusion will not interfere with removal of the cartridge from the station.

Recess depth, when greater than corresponding protrusion height may create free volume as a depth boundary zone (or height boundary zone) to serve the same purposes as width boundary zones so that width boundary zones may be reduced in volume.

Any feature discussed herein may include a width boundary zone and/or a depth (or height) boundary zone. Indexing structures, alignment structures, and/or removal structures may include analogous zones for analogous purposes.

For a cartridge to be used in a breech loaded weapon (e.g., a 12 ga. shotgun), the base of the cartridge that faces the breech block of the weapon may have a protrusion toward the breech block and/or a recess away from the breech block. The protrusion may have a height in the range from 0.030 inch to 0.100 inch. The recess may have a depth in the range from 0.030 inch to 0.100 inch. Similarly, a breech loaded weapon (e.g., a 12 ga. shotgun) to be used with such cartridges may have a breech block with a recess and/or a protrusion respectively to nest the feature of the cartridge. The protrusion of such a breech block may have a height in the range from 0.030 inch to 0.100 inch. The recess of such a breech block may have a depth in the range from 0.030 inch to 0.100 inch.

For cartridges and/or activators that include circular symmetry as discussed above, plural features may be arranged in concentric tracks each track at a different radius from a center of symmetry. For example, a first feature track at a first radius may include a continuous substantially uniform annular protrusion and a second feature track at a second radius may include a continuous substantially uniform annular recess at a second radius. Substantial uniformity assures circular symmetry. Each track may be used to create 6 compatible (e.g., interoperable) combinations and 3 incompatible (e.g., non-interoperable) combinations of activators and cartridges as described in Table 1. Multiple tracks may be used to create additional combinations as desired.

Variation along the circumference of a track may be used to create plural features (herein called serial coded features), for example, to create additional compatible and incompatible combinations of cartridges and activators. For example, plan 700 having overall radius of 716 and circumference 702 includes plural concentric tracks that may be applied to a cartridge and/or an activator. Plan 700 includes track 704 having radius 714, track 706 having radius 712, center 710 from which all radii are measured, and arc 723 between radial reference 722 and radial reference 724. In the example as shown, radius 712 is less than radius 714. Each track may be defined from a radius at its inner edge (as shown) or at its center or outer edge as desired. Track width may be determined so as to include suitable feature width and width boundary zones as discussed above.

Arc 723 may define a repeating unit of plural features arranged along the arc of a first track 704 (or 706). The remainder of the first track may repeat the unit for each successive arc of the same size as arc 723.

A second track 706 (or 704) may have one or more indexing structures designed to identify to the positioning mechanism, the station, and/or the activator an index from which to align a corresponding track for detecting compatibility. Alignment structures may be included to effect rotation of the cartridge (or the activator) about the center 710 when the cartridge and activator are brought together. The indexing structures and/or alignment structures of the second track 706 (or 704) may have height greater than the height of the compatibility enforcing features (e.g., 106, 114) of the first track 704 (or 706) so that registration (of the corresponding tracks having units of serial coded features) is completed before attempting detection of compatibility.

A cartridge may include a base and a projectile. The base may include a propellant and one or more features as discussed herein. The base may remain with the weapon after activation and be removed away from the activator, as discussed above. The propellant may propel (e.g., launch) the projectile away from the weapon and toward the target. For propulsion by expanding gas through a barrel, a wad may seal the barrel to reduce gas escaping around the projectile while in the barrel. The wad may be free to fall away from the projectile during flight of the projectile (e.g., after the projectile leaves a barrel). Otherwise, the wad may be attached to the projectile and serve an additional function related to flight of the projectile or related to impact of the projectile at the target. Stabilized flight of the projectile may be accomplished by causing the projectile to spin after activation (e.g., launching) of the cartridge. The projectile may include fins for causing spin by aerodynamics. The projectile may omit fins if launched through a rifled barrel and the rifling causes sufficient spin. The projectile may include a power supply (e.g., battery or charged capacitor). a signal generator, and electrodes to generate a current to pass through the target, as discussed above. The electrodes may include adhesive or barbs to attach the projectile to the target. The projectile may also include a payload that remains with the projectile after impact with the target, is dispensed during flight, or dispensed on impact with the target. The payload may operate during flight and/or after impact with the target. The payload may use power from the power supply to enable one or more of its functions (e.g., begin dispersing, ignite pyrotechnics, conduct measurement and/or telemetry functions). The complement of structures and functions included in a particular cartridge may be tailored to different market segments. The features on the base of the projectile may assure use of particular cartridges with particular activators, as discussed above, by inhibiting activation of a particular projectile in an unsuitable weapon.

Figure 8:
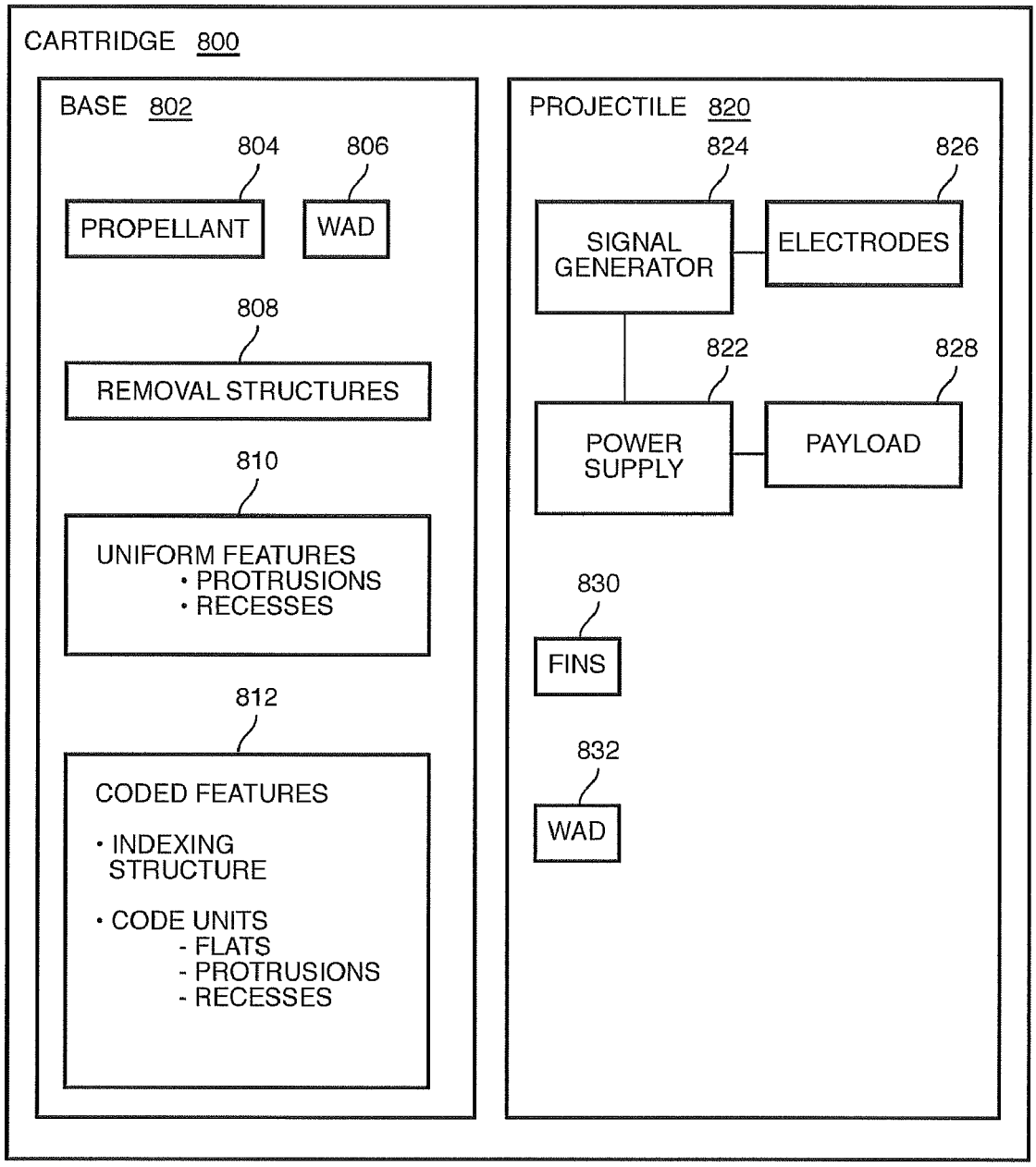
FIG. 8 is a functional block diagram of a cartridge, according to various aspects of the present invention.

For example, cartridge 800 of FIG. 8 includes base 802 and one or more projectiles 820 (one shown). Base 802 includes propellant 804, wad 806, removal structures 808, and features as discussed above. Features include substantially uniform features 810 and/or serial coded features 812 (e.g., 723). The projectile 820 includes power supply 822, signal generator 824, electrodes 826, payload 828, fins 830, and wad 832. In operation, cartridge 800 may perform any and all of the cartridge functions discussed above. Cartridge 800 may be placed in a conventional weapon having no features (e.g., electronic control device, handgun, rifle, shot gun, grenade launcher, mortar) or in a weapon of the present invention (e.g., having an activator with one or more features) and, if conditions for activation are met (e.g., features of the cartridge do not interfere with features (if any) of the activator), the cartridge may be activated. When activated, the projectile may be launched away from the cartridge.

Base 802 may include a pyrotechnic propellant for operation in a chamber of a barrel. Propellant 804 may include a conventional percussion fired primer and powder that releases gas for propelling the projectile through a barrel. Propellant 804 may be formed in a separate assembly (e.g., brass) and pressed into base 802 (plastic). Wad 806 may seal the gas into the barrel and slide along the barrel as the gas expands to propel the projectile. Wad 806 may further include conventional pyrotechnics (e.g., report, tracer smoke, muzzle flash, tracer combustibles) for drawing attention to the use of the projectile (e.g., for crowd control purposes). Following activation of the cartridge, one or more removal structures 808 may provide one or more surfaces for removal of the cartridge from the weapon (e.g., grasping and/or throwing the spent cartridge 800 away from the activator).

One or more features 810, 812, as discussed above for conditional activation, may be included in base 802. Substantially uniform features 810 may include protrusions and/or recesses arranged about an axis of symmetry. One substantially uniform feature is substantially uniform in at least one dimension (e.g., width, height, depth, length) throughout a region sufficient for symmetry (e.g., a ring, circle, half annulus, line, perimeter). Multiple substantially uniform features of the same type (e.g., two circular protrusions of the same height), of mixed types (e.g., a circularly symmetric protrusion and a circularly symmetric recess), and/or of mixed dimensions (e.g., different heights, depths, widths, lengths) may be used. Serial coded features may be arranged about an axis of symmetry (e.g., on a circumference of a circle, on a perimeter of a polygon, a regularly distributed flat pencil of lines from a point). Serial coded features may be arranged with reference to one or more indexing structures. An indexing structure assures that one set of features (e.g., on a cartridge) is properly aligned with a second set of features (e.g., on an activator). In a simple symbol grammar, each feature of a code unit of serial coded features may include one of three features: a flat, a protrusion, or a recess. Other serial code unit symbol grammars may include features of different dimensions and/or different locations relative to the indexing structures.

Projectile 820 may include a wad 832 that performs one or more of the functions discussed above with reference to wad 806, except that wad 832 may remain with projectile 820 for some or all of its flight toward the target. Wad functions may be performed by wads 806 and/or 832 with the omission of the other wad.

The flight of projectile 820 may be spin stabilized by fins 830 or by cooperation of projectile 820 with rifling of a barrel used to guide the initial portion of the flight.

A projectile may perform one or more lethal and non-lethal functions, as discussed above. For example, projectile 820 performs non-lethal functions including electric control of the target (via power supply 822, signal generator 824, and electrodes 826). When no other functions are desired, payload 828 may be omitted.

Particular synergies are realized, according to various aspects of the present invention, by combining a set of features of the cartridge (e.g., to define a cartridge type) with a selection of particular structural and/or functional aspects of the cartridge (e.g., propellant, wads, removal structures, electric control of the target, spin stabilization, and payloads). Additional particular synergies are realized according to various aspects of the present invention by defining a set of features of the activator (e.g., to define a weapon type) for compatibility with some cartridge types and for incompatibility with other cartridge types. Limited interoperability of cartridges and weapons results.

For instance, the combinations and purposes served by exemplary types of cartridges and exemplary types of weapons each type having no features, one feature, or two features are described in Tables 2 through 7. In this example, the first feature is implemented on a circular track at radius R1. The second circular feature is implemented on a second circular track at radius R2, concentric with the first track. (e.g., see also FIG. 6). R1, R2, the difference between R1 and R2 are all selected for reliable detecting of compatibility, inhibiting of activation, and/or noninterference with removal. Because non-lethal projectile muzzle velocities are desired to be significantly less than those of lethal projectiles, the propellant may have less thermal effect on the cartridge and the weapon. For example, the base of a cartridge may be formed of plastic (e.g., polystyrene, polyethylene, high density polymer) and the features, indexing structures, and/or removal structures may be formed by any conventional plastics manufacturing techniques (e.g., by injection molding).

Four types of cartridges are defined in Table 2. Because each cartridge is not compatible with some types of weapons defined in Table 2, different markets for lethal and non-lethal uses may be served with cartridges of different types. Cartridge type A is a conventional cartridge without features as taught herein. Each cartridge type B though D has a base with a unique set of features according to various aspects of the present invention.

TABLE 2

| Cartridge Features | Cartridge Purpose |
|---|---|
| A. Flat | Lethal |
| B. Recess at radius R1 | Non-lethal, consumer purposes |
| C. Recess at radius R1 and protrusion at radius R2, where R1 < R2 | Non-lethal, law enforcement purposes |
| D. Protrusion at radius R2 | Non-lethal, military purposes |

Four types of weapons are defined in Table 3. Because each weapon is not compatible with some types of cartridges, different markets for lethal and non-lethal uses may be served with weapons of different types. Weapon type 1 is a conventional weapon without features as taught herein. Each weapon type 2 though 4 has an activator with a unique set of features according to various aspects of the present invention.

TABLE 3

| Activator Features | Weapon System Lethal Uses | Weapon System Non-Lethal Purpose |
|---|---|---|
| 1. Flat | All existing lethal cartridges | Cartridges for consumer use |
| 2. Protrusion at radius R1 | None | Cartridges for consumer use |
| 3. Protrusion at radius R1 and recess at radius R2, where R1 < R2 | None | Cartridges for consumer or law enforcement use |
| 4. Recess at radius R2 | Cartridges for military lethal use | Cartridges for military non-lethal use |

As described in Table 4, only 9 of 16 weapon systems involve compatible cartridges as in Table 2 and activators as in Table 3. Seven weapon systems involve incompatible activators and cartridges. Cartridges of each types A, C, and D are interoperable among a respective limited number of weapon types. Weapon types 1, 2, and 3 are interoperable among a respective limited number of cartridge types.

TABLE 4

| Weapon | Cartridge Type and Compatibility with Weapon | | | |
|---|---|---|---|---|
| Type | A | B | C | D |
| 1 | yes | yes | no | no |
| 2 | no | yes | no | no |
| 3 | no | yes | yes | no |
| 4 | yes | yes | yes | yes |

Figure 2:
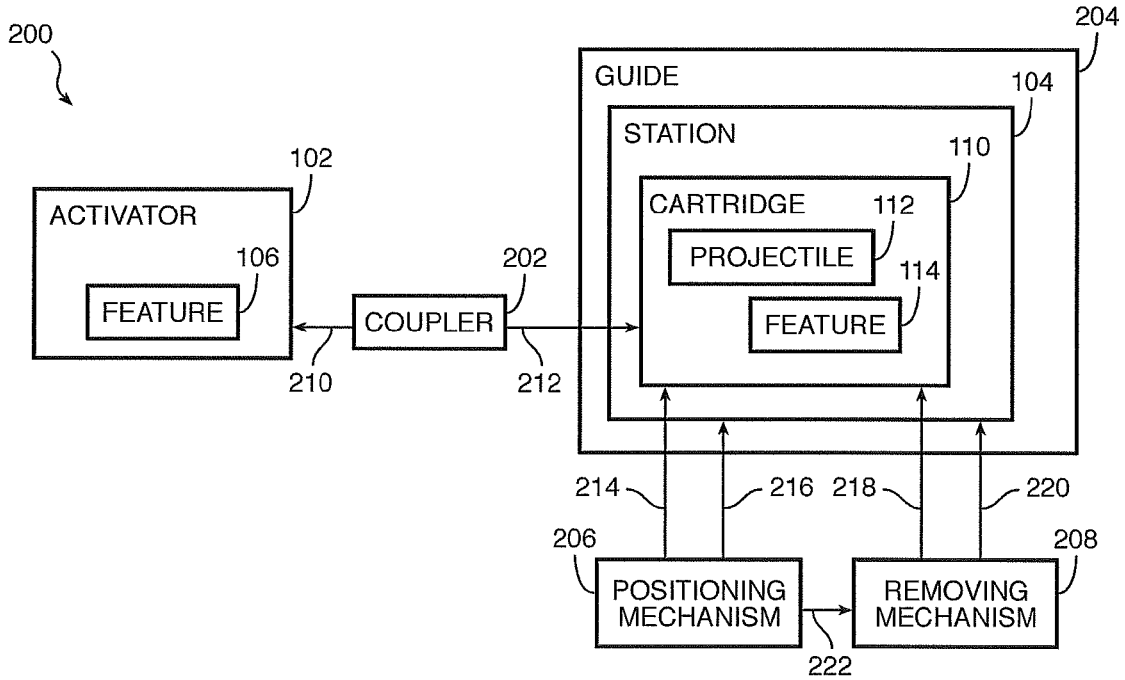
FIG. 2 is a functional block diagram of another system, according to various aspects of the present invention.

For weapons described in Table 3 and with reference to FIG. 2 having a guide comprising a barrel, the barrel may be rifled or smooth for cooperation with various projectile spin stabilization techniques as described in Table 5.

TABLE 5

| Weapon Type | Weapon Features |
|---|---|
| 1 | steel barrel, smooth bore |
| 2 | aluminum barrel, smooth bore |
| 3 | aluminum barrel, rifled bore |
| 4 | steel barrel, rifled bore |

As discussed above, a cartridge may include a projectile, herein called an electrified projectile, comprising a power supply and signal generator for conducting a current through tissue of a target. Three types of such cartridges may be marketed to three different markets as described in Table 6 due to the compatibility and lack of compatibility with various weapon types, discussed above.

TABLE 6

| Function of a Cartridge Having a Non-lethal Electrified Projectile | Consumer Type | Law Enforcement Type | Military Type |
|---|---|---|---|
| Base Features | B as in Table 2 | C as in Table 2 | D as in Table 2 |
| Firing | Percussion center fired | Percussion center fired | Percussion center fired |
| Propellant | Short range | Medium range | Long range |
| Front of Projectile | Barbed electrodes | Barbed electrodes | Barbed electrodes |
| Rear of Projectile | No payload | Payload | Payload |
| Payload alternatives | None | no payload, pepper spray, flash, bang, flash and bang | no payload, pepper spray, flash, bang, flash and bang |
| Muzzle effect | None | Flash | None |
| Wad effect | None | Wad provides tracer glare | None |
| Spin stabilization | Fins | In barrel, no fins needed | In barrel, no fins needed |
| Stimulus | 30-second halting of locomotion | retriggerable 30-second halting of locomotion | retriggerable 30-second halting of locomotion |
| Telemetry between weapon and projectile | None | retriggering; control measurement and/or receive biometrics measured by projectile | retriggering; control and/or receive audio sensed by projectile |

As discussed above, a cartridge may include a projectile, herein called a non-electrified projectile, that does not include a power supply or signal generator for conducting a current through tissue of a target. Three types of such cartridges may be marketed to three different markets as described in Table 7 due to the compatibility and lack of compatibility with various weapons, discussed above. Payloads for law enforcement purposes may assist in crowd control, SWAT team missions, and general arrests.

TABLE 7

| Function of a Cartridge Having a Non-lethal, Non-Electrified Projectile | Consumer Type | Law Enforcement Type | Military Type |
|---|---|---|---|
| Base Features | B as in Table 2 | C as in Table 2 | D as in Table 2 |
| Usage | Warning flare | Substitute for electrified projectile for low cost accuracy training and mission practice | Bean bag assault |
| Propellant | Short range | Medium range | Long range |
| Front of Projectile | No electrodes and no payload | No electrodes; includes payload | No electrodes; includes payload |
| Payload alternatives | None | no payload, marker, pepper spray, flash, bang, flash and bang | no payload, marker, pepper spray, flash, bang, flash and bang |
| Spin stabilization | Fins | In barrel, no fins needed | In barrel, no fins needed |

For the sake of clarity of description of the invention, features that define a type of weapon have been associated with an activator. In another weapon, according to various aspects of the present invention, features that define a type of weapon are formed on or in a station. In still another weapon, according to various aspects of the present invention, features that define a type of weapon are formed on or in a coupler. In still another weapon, according to various aspects of the present invention, features that define a type of weapon are formed on or in a positioning mechanism. In still another weapon, according to various aspects of the present invention, features that define a type of weapon are formed on or in a removing mechanism. In still another weapon, according to various aspects of the present invention, features that define a type of weapon are formed on or in one or more of an activator, a coupler, a station, a positioning mechanism, and/or a removing mechanism.

Related technologies (methods and apparatus) that may be adapted and/or used with technologies disclosed herein to implement the present invention in various forms include propellant systems, electronic control devices, and electrified projectiles described in, for example, U.S. Pat. Nos. 5,078,117, 5,936,183, 5,955,695, 6,636,412, 6,898,887, 7,042,696, 7,057,872, 7,075,770, 7,102,870, 7,145,762, 7,280,340, 7,305,787, 7,409,912; US Published Patent applications 2006/0279898, 2007/0075261, 2007/0081292, 2007/0081293, 2007/0214993, and 2008/0259520; and U.S. patent application Ser. Nos. 11/771,126, 11/771,240, 11/771,956, and 11/868,512; each of which is incorporated herein by reference.

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A cartridge for use with a provided weapon, the weapon comprising an activator, a chamber, and a first mechanical feature, the activator for activating in accordance with up to a maximum head space, the cartridge comprising:

a. an electrified projectile for conducting a current through a human or animal target, the current for interfering with locomotion by the target by causing contractions of skeletal muscles of the target;

b. a base for cooperation with the activator to propel the projectile from the cartridge; and c. a second mechanical feature that indicates a capability of the cartridge, wherein d. the electrified projectile is operative when not coupled to the base or the cartridge;

e. the second mechanical feature does not facilitate removal of the cartridge from the weapon;

f. the second feature, when the cartridge is positioned in the chamber and opposed by an incompatible first feature, provides head space greater than the maximum head space thereby inhibiting activation; and g. the second feature, when the cartridge is positioned in the chamber and opposed by a compatible first feature, does not provide head space equal to or greater than the maximum head space thereby permitting activation.

2. The cartridge of claim 1 wherein:

a. the electrified projectile comprises an axis of propulsion;

b. the cartridge further comprises a structure that facilitates removing the cartridge from the weapon; and c. the second mechanical feature is closer to the axis than the structure for removing is from the axis.

3. The cartridge of claim 1 wherein the capability comprises deploying a non-lethal force.

4. The cartridge of claim 1 wherein the electrified projectile comprises a signal generator for providing the current through the target.

5. The cartridge of claim 1 wherein:

a. the cartridge further comprises a propellant for propelling the electrified projectile; and b. the base is responsive to a firing pin of the activator for activating the propellant.

6. The cartridge of claim 1 wherein:

a. the cartridge further comprises a propellant for propelling the electrified projectile; and b. the base is responsive to a current provided by the activator for activating the propellant.

7. The cartridge of claim 1 wherein the second mechanical feature consists essentially of a recess having a depth.

8. The cartridge of claim 7 wherein the depth is at least $^{30}/_{1000}$ of an inch.

9. The cartridge of claim 7 wherein the depth is at most $^{100}/_{1000}$ of an inch.

10. The cartridge of claim 1 wherein:

the second mechanical feature comprises a first portion and a second portion;

the first portion comprises a first dimension; and the second portion comprises a second dimension.

11. The cartridge of claim 1 wherein the second mechanical feature nests with the first mechanical feature when the second mechanical feature is compatible with the first mechanical feature.

12. The cartridge of claim 1 wherein the base comprises the second mechanical feature.

13. The cartridge of claim 1 wherein:

a. the electrified projectile has an axis of propulsion; and b. the second mechanical feature has a symmetry about the axis.

14. The cartridge of claim 13 wherein at least one of a height, a depth, or a width of the second mechanical feature varies about the axis.

15. The cartridge of claim 1 wherein the indicated cartridge capability describes a range of deployment of the projectile.

16. The cartridge of claim 1 wherein the indicated cartridge capability describes a muzzle effect.

17. The cartridge of claim 1 wherein the indicated cartridge capability describes a wad effect.

18. The cartridge of claim 1 wherein the indicated cartridge capability describes a stabilization technique for the electrified projectile.

19. The cartridge of claim 1 wherein the indicated cartridge capability describes an electrical control capability for controlling a target.

20. The cartridge of claim 1 wherein the indicated cartridge capability describes a telemetry capability of the projectile.

21. The cartridge of claim 1 wherein the indicated cartridge capability describes a projectile for accuracy training.

22. A cartridge that is conditionally activated by a provided activator, the activator comprises a first mechanical feature being one of a first flat, a first recess, and a first protrusion, the cartridge comprising:

an electrified projectile operative when not coupled to the cartridge; and a second mechanical feature being one of a second flat, a second recess, and a second protrusion; wherein:

the first feature and the second feature do not participate in removal of the cartridge away from the activator;

if the first feature interferes with the second feature, the cartridge is positioned a first distance away from the activator thereby inhibiting the activator from activating the cartridge; and if the first feature does not interfere with the second feature, the cartridge is positioned a second distance away from the activator for activation of the cartridge to launch the projectile away from the cartridge.

23. The cartridge of claim 22 further comprising:

a percussion fired pyrotechnic propellant for propelling the projectile; and a base to receive a firing pin of the activator for percussion fired activation to propel the projectile; wherein:

the base comprises the second feature;

if the first feature interferes with the second feature, the base is positioned with respect to the activator to provide excess head space that prohibits the firing pin from striking the base to activate percussion firing; and if the first feature does not interfere with the second feature, the base is positioned with respect to the activator to provide less than excess head space that does not prohibit the firing pin from striking the base to activate percussion firing.

24. The cartridge of claim 22 further comprising a removal structure for cooperating with a provided removing mechanism to move the projectile away from the activator.

25. The cartridge of claim 22 wherein the first feature is symmetric about an axis of symmetry of the cartridge.

26. The cartridge of claim 22 wherein the first feature further comprises:

a width boundary zone.

27. The cartridge of claim 22 wherein the first feature is located on any one or more of the following:

a surface proximate to a percussion primer of the cartridge;

a surface proximate to a contact for a firing current that activates the cartridge;

a surface on a base of the cartridge; and a surface proximate to an axis of symmetry of the cartridge.

28. The cartridge of claim 22 wherein the second feature is symmetric about an axis of symmetry of the cartridge.

29. The cartridge of claim 22 wherein the second feature further comprises a width boundary zone.

30. The cartridge of claim 22 wherein the second feature is located on any one or more of the following:

a surface proximate to a percussion primer of the cartridge;

a surface proximate to a contact for a firing current that activates the cartridge;

a surface on a base of the cartridge; and a surface proximate to an axis of symmetry of the cartridge.

31. The cartridge of claim 22 wherein the cartridge has a symmetry about an axis of symmetry.

32. The cartridge of claim 22 wherein the second feature has a respective radius about an axis of symmetry of the activator.

33. The cartridge of claim 22 wherein a height of a protrusion feature is more than a depth of an opposing recess feature thereby resulting in the interference.

34. The cartridge of claim 22 wherein the first feature further comprises a depth boundary zone.

35. The cartridge of claim 22 wherein the first feature further comprises a height boundary zone.

36. The cartridge of claim 22 wherein the second feature further comprises a depth boundary zone.

37. The cartridge of claim 22 wherein the second feature further comprises a height boundary zone.

* * * * *